US006327802B1

(12) United States Patent
Baxter et al.

(10) Patent No.: US 6,327,802 B1
(45) Date of Patent: Dec. 11, 2001

(54) WINDOW DISPLAY ARRANGEMENT

(75) Inventors: Philip William Baxter, Norton Lees (GB); Malcolm Tyas, Dodworth (GB)

(73) Assignee: Edward Pryor & Sons, Ltd. (GB)

( * ) Notice: Subject to any disclaimer, the term of this patent is extended or adjusted under 35 U.S.C. 154(b) by 0 days.

(21) Appl. No.: 09/367,968

(22) PCT Filed: Feb. 20, 1998

(86) PCT No.: PCT/GB98/00555

§ 371 Date: Aug. 20, 1999

§ 102(e) Date: Aug. 20, 1999

(87) PCT Pub. No.: WO98/37537

PCT Pub. Date: Aug. 27, 1998

(30) Foreign Application Priority Data

Feb. 22, 1997 (GB) ..... 9703719

(51) Int. Cl.[7] ..... G09F 7/04

(52) U.S. Cl. ..... 40/564; 362/812; 40/600; 40/594

(58) Field of Search ..... 40/564, 575, 580, 40/600, 593, 594; 362/812

(56) References Cited

U.S. PATENT DOCUMENTS

| | | | | |
|---|---|---|---|---|
| 4,277,904 | * | 7/1981 | Leuthesser | 40/564 |
| 4,450,640 | | 5/1984 | Shapiro et al. | 40/596 |
| 4,848,017 | * | 7/1989 | Bailey et al. | 40/564 |
| 4,860,476 | * | 8/1989 | Hall | 40/593 |
| 4,953,315 | * | 9/1990 | Romaine | 40/593 |
| 5,367,806 | | 11/1994 | Hoffman | 40/544 |
| 5,533,289 | | 7/1996 | Hoffman | 40/544 |
| 5,557,869 | * | 9/1996 | Douglas | 362/812 |

FOREIGN PATENT DOCUMENTS

| | | |
|---|---|---|
| 2 733 074 | 10/1996 | (FR) . |
| 2038526A | 7/1980 | (GB) . |
| 2224385A | 2/1990 | (GB) . |

* cited by examiner

*Primary Examiner*—Brian K. Green
*Assistant Examiner*—James M Hewitt
(74) *Attorney, Agent, or Firm*—Madson & Metcalf

(57) ABSTRACT

A window display arrangement having a support and a lightbox is disclosed. The support has a first side to which an adhesive is applied so that the support can be secured to a window and a second side having a releasable fastener. The lightbox further includes a housing having a releasable fastener which can co-operate with the releasable fastener on the support to releasably fasten the lightbox to the support. Light from an illumination source in the housing is directed towards an image located when the arrangement is in use between the support and the lightbox, so that the illuminated image can be viewed through the window.

20 Claims, 6 Drawing Sheets

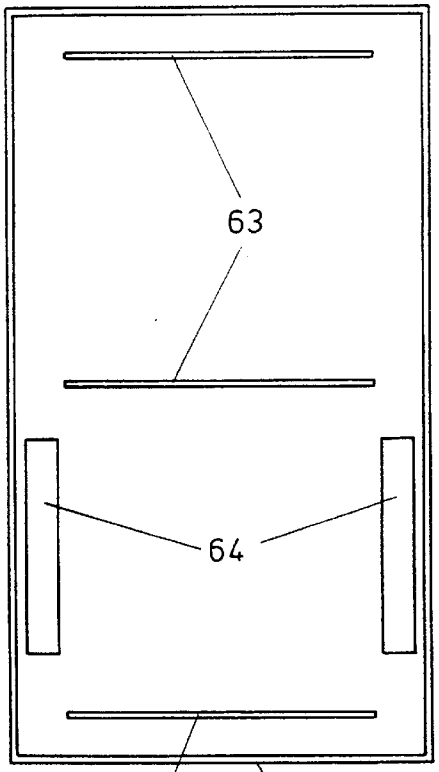
FIG. 6c
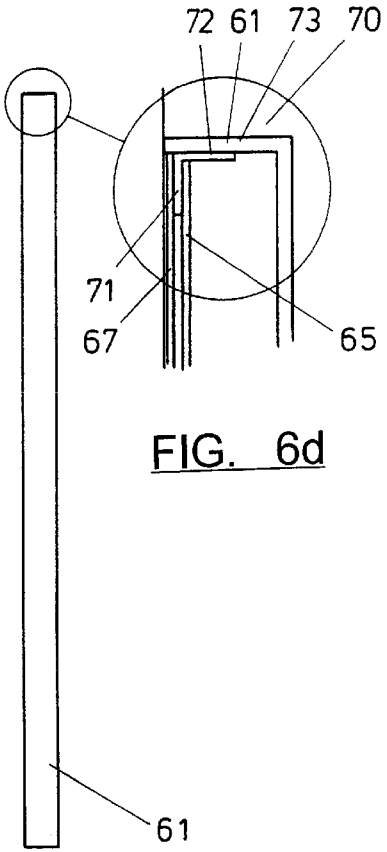
FIG. 6d
FIG. 6b
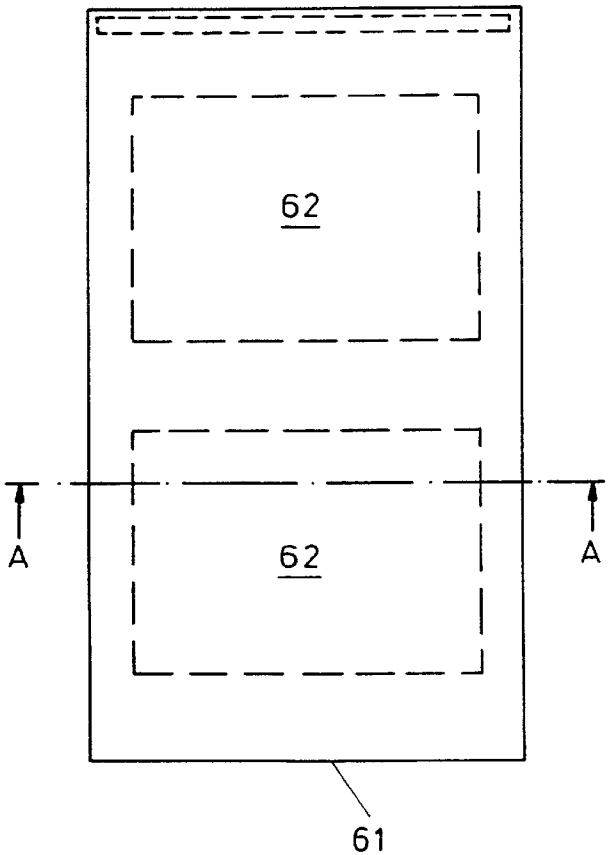
FIG. 6a

WINDOW DISPLAY ARRANGEMENT

BACKGROUND OF THE INVENTION

The present invention relates to a window display arrangement and particularly to an arrangement for illuminating images displayed in the windows of business and retail premises. Illumination of images displayed in business and retail premises' windows enhances their appearance thereby drawing the attention of passers by to the images so that they serve as an improved form of advertising.

Previously window displays with illuminated images have used spotlights or ceiling mounted lights to illuminate the images by reflecting light off the images. However, this requires that the images are not flush with the window which can lead to unsightly multiple reflections and uneven illumination. Lightboxes which hang from the ceiling or are supported on the ground have also been provided previously. However, such an arrangement requires that the images are not flush with the window, so the images are not in the best position for viewing from outside the window. Further, they are bulky in size and take up space in a window display area. Furthermore, they are not adapted to allow easy changing of the images and are generally constructed to contain one image only.

SUMMARY OF THE INVENTION

In one aspect, the invention provides a window display arrangement comprising a support and a lightbox, in which:

the support has a first side to which an adhesive is applied so that the support can be secured to a window and a second side having support releasable fastening means;

the lightbox comprises a housing having housing releasable fastening means which can co-operate with the support releasable fastening means so as releasably to fasten the lightbox to the support so that light from an illumination source in the housing is directed towards an image located, when the arrangement is in use, between the window and the lightbox, so that the illuminated image can be viewed through the window.

Providing a support which is permanently secured to a window and a lightbox which can be releasably fastened to it makes it easier to change the images being illuminated. This also makes it easier to remove the lightbox so as to fix any faults in it. The support may be permanently secured directly to the surface of the window or permanently secured to the window by an intervening member. The adhesive may be in the form of double sided adhesive tape or it may be a spreadable adhesive, such as an epoxy resin or commercially available glues. The adhesive may cover regions of the first side of the support or the entire surface area of the first side of the support. Although the support is permanently secured to a window by an adhesive, it will be understood that it will still be possible to remove the support form the window should the display arrangement no longer be required, or its position in the window need to be changed.

Preferably, the support releasable fastening means and the housing releasable fastening means are formations which can mate with each other so as releasably to fasten the lightbox to the support.

Preferably, the first side of the support is substantially planar. This maximises the surface area of the support that adheres to the window which increases the supporting force provided by the support. If less surface area of the support were in contact with the window then the shear force required to remove the support would be less and so the support would provide a weaker support for the lightbox.

Preferably, the lightbox has an illumination source in it, the support has a viewing region and a masking region and the masking region masks the illumination source when the lightbox is fastened to the support. This helps reduce direct illumination of the image and so provides a more uniform illumination of the image and prevents unsightly bright patches. Although this is the preferred arrangement, the illumination source may be positioned directly behind the images so as to directly illuminate them without being masked. The positioning of the illumination source depends on the nature of the images being illuminated. When the images are paper prints bearing text then the masked arrangement is preferred. When the images are colour transparencies then the illumination source may be directly behind the images.

Preferably, the support has more than one viewing region and the illumination source comprises more than one light source. As more than one viewing region and more than one light source are provided, a number of different images may be illuminated and it is possible to selectively illuminate the different images.

Preferably, the lightbox has a reflective internal surface which directs light from the illumination source towards the image. This helps to provide a more uniform illumination of the image.

Preferably one of the support releasable fastening means and housing releasable fastening means are studs and the other one are holes. Preferably, the support releasable fastening means and housing releasable fastening means co-operate magnetically. The housing releasable fastening means may be a magnet and the support releasable fastening means may be a material to which the magnet will magnetically adhere. However, any other form of releasable fastening means is also envisaged, such as snap-fit fasteners, slide together formations, threaded nuts and bolts and holes, hooks and eyes or press-stud fasteners. The support releasable fastening means and the housing releasable fastening means may have locking devices releasably to lock the support and the housing together when mated.

The support may have a locating formation which co-operates with the lightbox to ensure that the lightbox and support are correctly aligned when the arrangement is assembled.

BRIEF DESCRIPTION OF THE DRAWINGS

The invention will be better understood from the following detailed description of specific illustrative embodiments with reference to the accompanying drawings, wherein:

FIGS. 6*a*, 6*b*, and 6*c* are rear, side and internal views of an alternative arrangement, and FIG. 6*d* is an expanded detail of the arrangement.

DETAILED DESCRIPTION OF THE DRAWINGS

Figure 1:
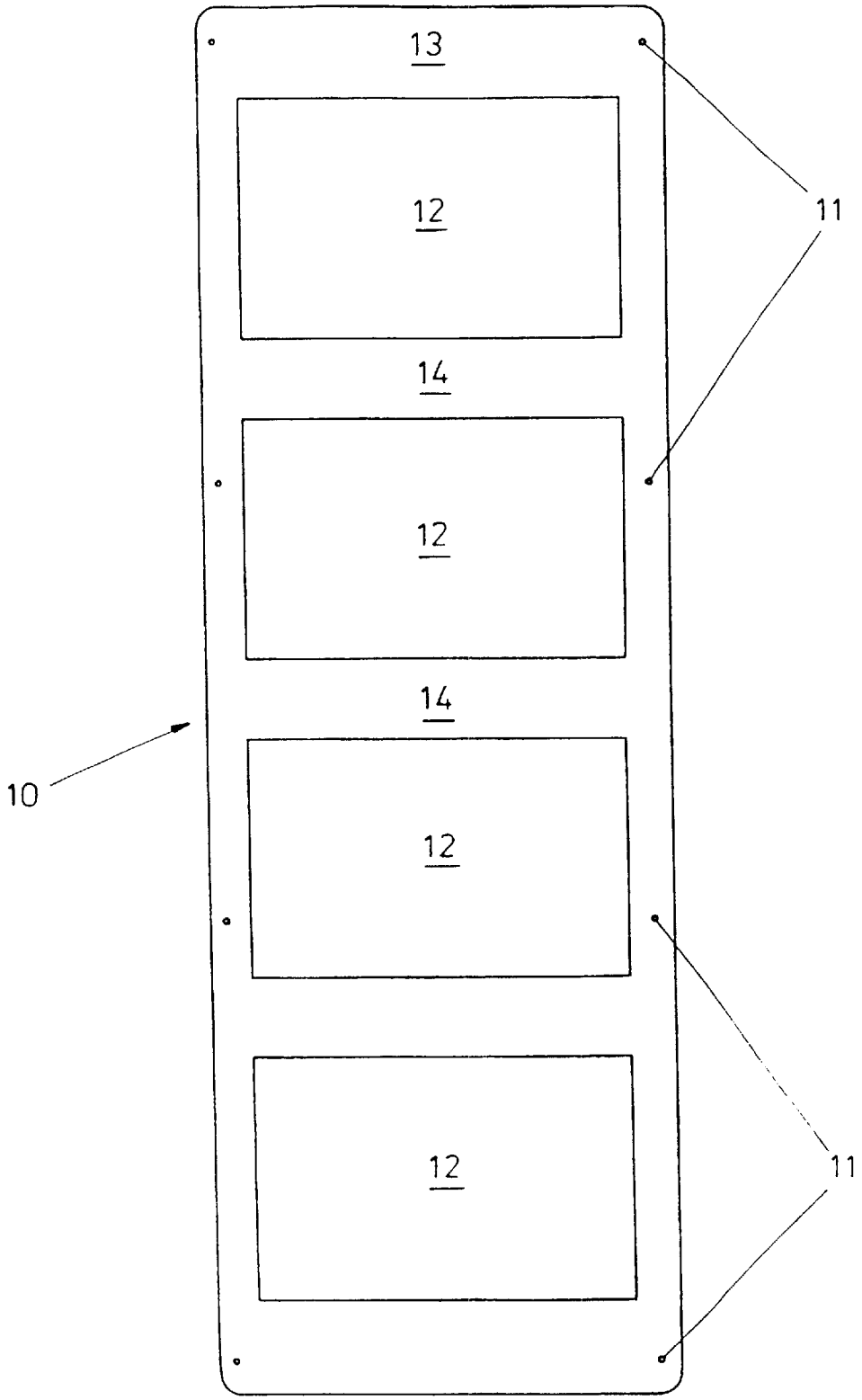
FIG. 1 is a view of the second side of the support of the arrangement.

With reference to FIG. 1, there is shown a support generally designated by reference numeral 10. The support has two sides. The first side of the support has substantially planar surface. FIG. 1 shows the second side of the template which has releasable fastening means in the form of a number of support formations in the form of protruding studs 11 around its periphery. The support has four viewing regions in the form of apertures 12 and masking regions 13, 14 around the apertures which act as illumination source masks as will be described later.

The support is made from aluminium. The support is less than 3 mm thick and preferably is approximately 2 mm thick. The first side of the support has double sided adhesive tape applied to it. The studs are approximately 10 mm long.

Figure 2C:
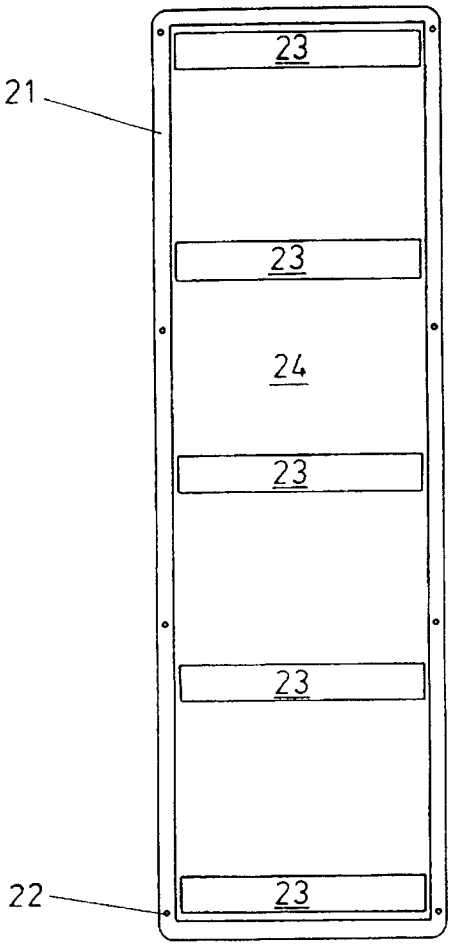
FIGS. 2*a*, 2*b* and 2*c* are three views of the liqhtbox the arrangement.
Figure 2B:
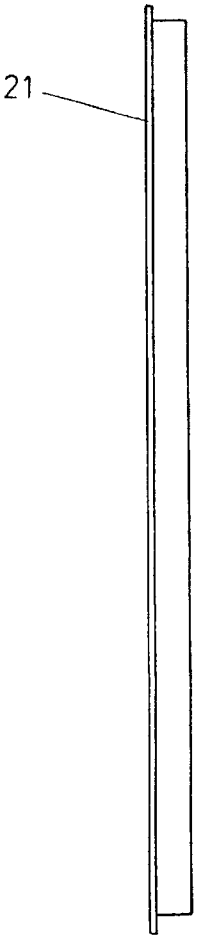
Figure 2A:
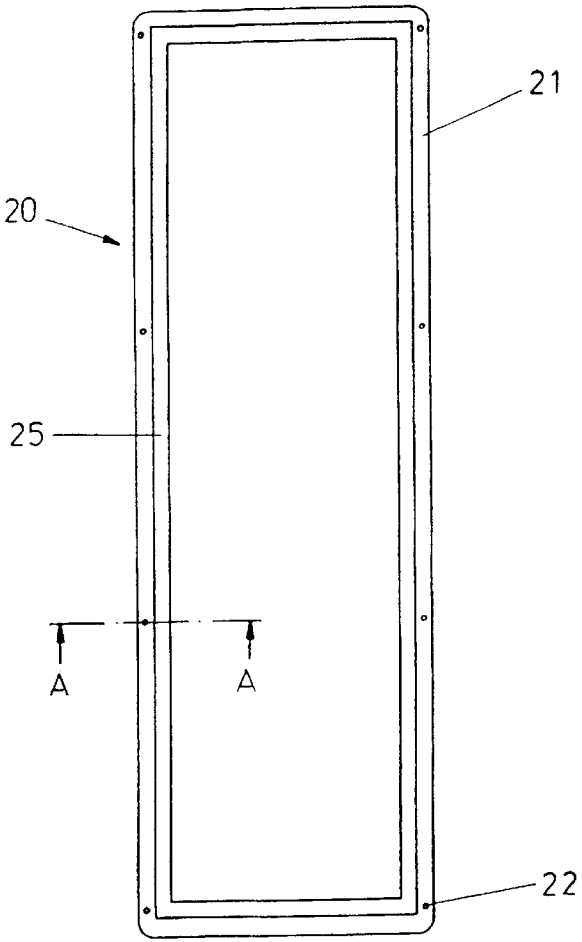

With reference to FIGS. 2*a*, 2*b* and 2*c* there is shown a lightbox, generally designated by reference numeral 20. The housing of the lightbox is a right rectangular box with an open face and a peripheral flange 21 running around the edge of the open face of the box. FIG. 2*a* shows a view of the rear of the lightbox, FIG. 2*b* a side view and FIG. 2*c* a view of the inside of the lightbox through the open face. A number of housing releasable fastening means in the form of holes 22 are provided in the peripheral flange. Five fluorescent tubes 23 mounted in the lightbox constitute light sources which provide an illumination source. The lightbox has a reflective, white resin inner surface 24 and a recessed border 25 is provided around the base of the lightbox.

Figure 3:
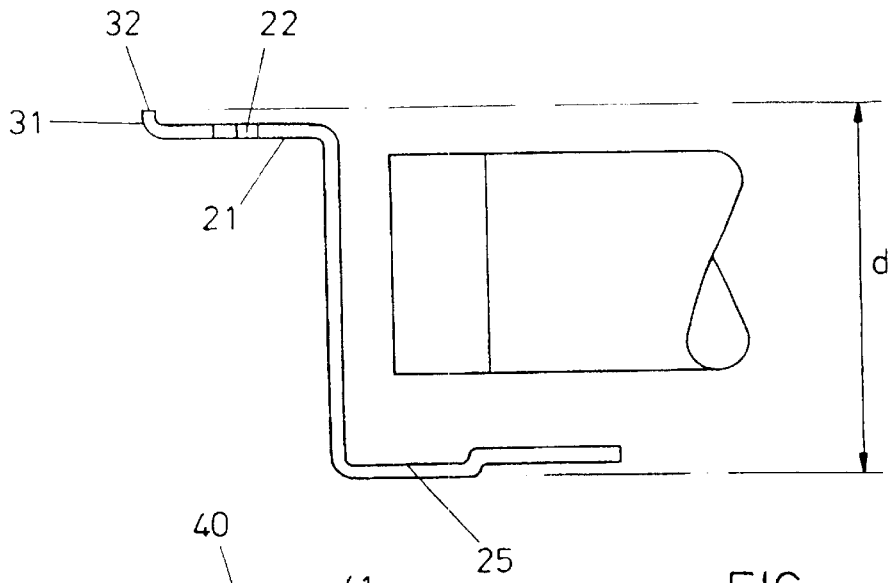
FIG. 3 is a section taken across A—A in FIG. 2*a*.

FIG. 3 shows cross section A—A of FIG. 2*a* and like reference numerals are used to indicate like parts. The flange 21 has an upturned edge 31 around its periphery which provides a 2 mm deep recess so that the end surface of the upturned edge 32 is flush with the first side of the support when the lightbox and support are assembled in use. The depth of the lightbox, i.e. distance d, is 60 mm. The holes 22 have a diameter of 8 mm. The lightbox is less than 3 mm thick and preferably is approximately 2 mm thick. The lightbox is made from glass reinforced polyester, commonly known as fibre glass. Supports, electrical connectors and wiring are provided for the fluorescent tubes but are not shown in the Figures.

Figure 4:
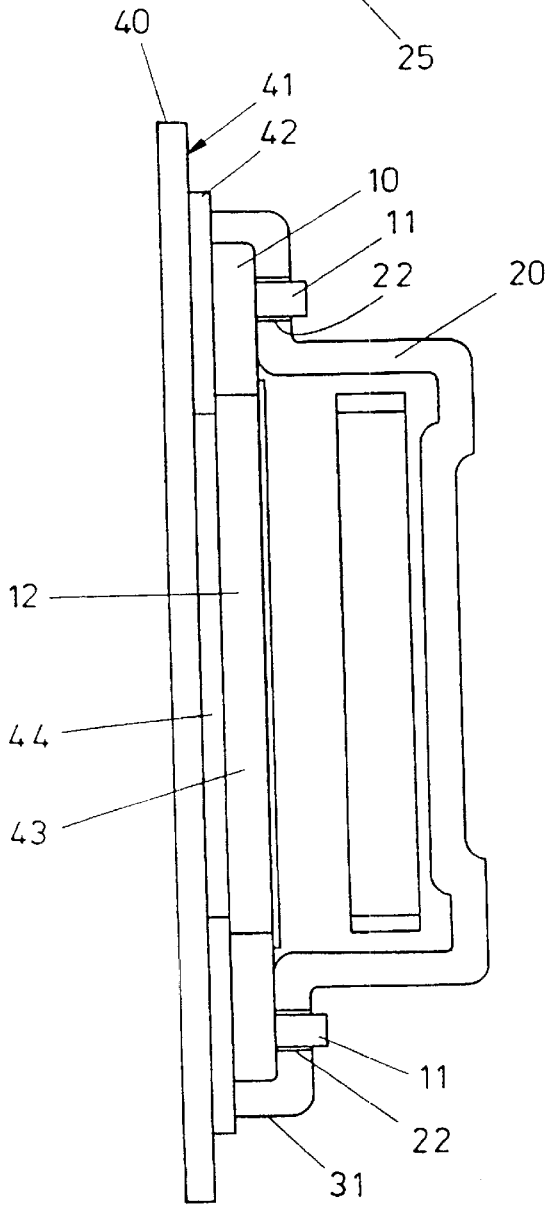
FIG. 4 is a cross section of a side view of the arrangement in use.

FIG. 4 shows a schematic cross section through the window display arrangement according to the present invention when it is assembled in use. The arrangement is mounted on the inside 41 of a shop window 40. A layer of decorative opaque vinyl material 42 forming part of the window display is attached directly to the inner surface of the window. The support 10 is permanently secured to the vinyl by the double sided adhesive tape (not shown) applied to the first surface of the support. An image 43 to be illuminated is attached to the support and positioned within one of the viewing regions 12, i.e. apertures, of the support. The lightbox 20 is releasably fastened to the support by engaging the studs 11 on the support with respective holes 22 in the peripheral flange of the lightbox. Locking devices (not shown), such as spring clips, are provided releasably to lock the studs in place when engaging the holes. Openings 44 are provided in the opaque vinyl material which provides frames for the illuminated images and allows them to be viewed while hiding the support and lightbox of the arrangement.

Figure 5:
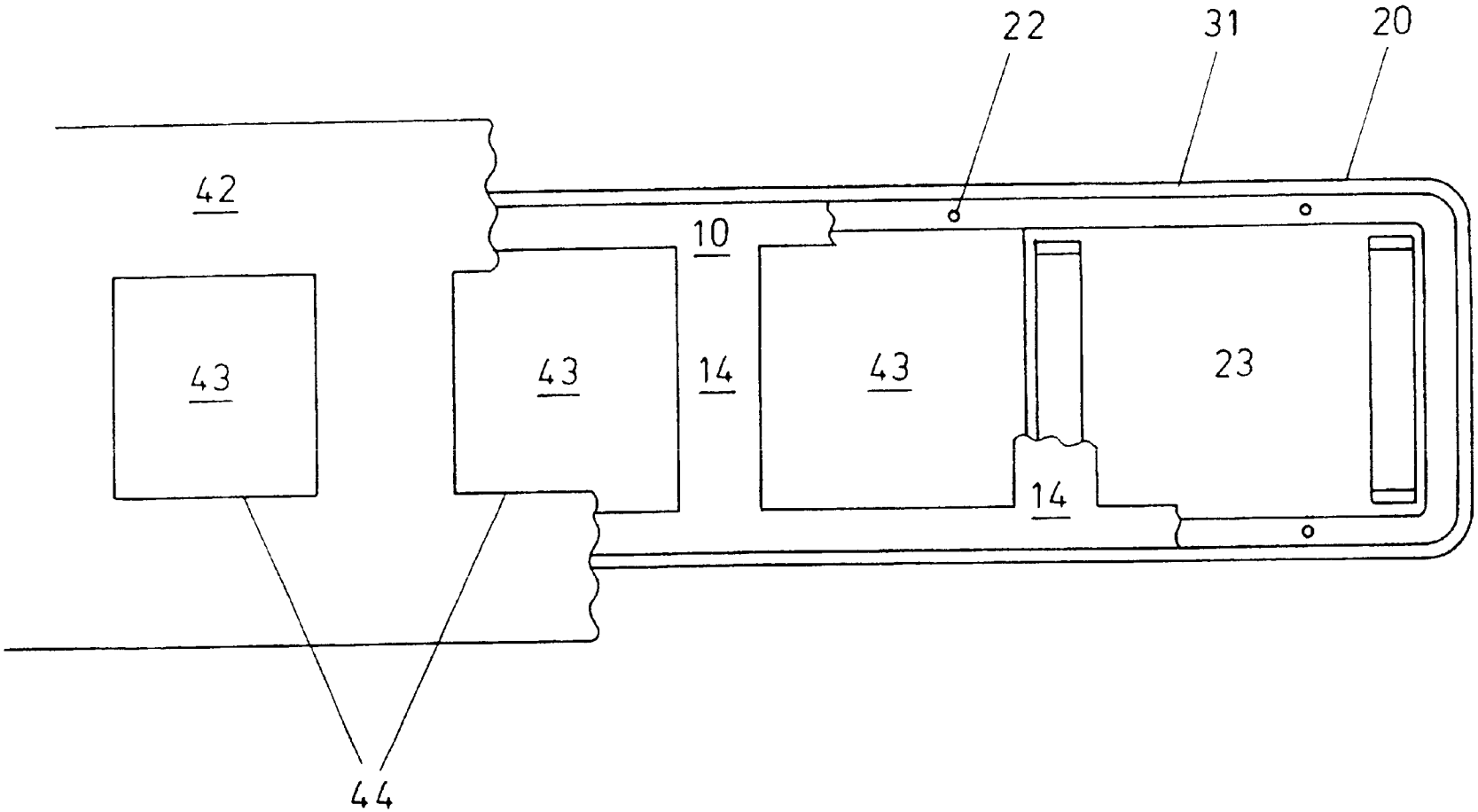
FIG. 5 is a partially sectioned front view of the arrangement in use.

The vinyl 42, support 10, images 43 and lightbox 20 are configured so as to provide the following results, as illustrated in FIG. 5. When the arrangement is assembled and in use, the openings 44 in the opaque vinyl material 42 provide frames for the illuminated images 43 and hide the arrangement. The support has masking regions 13, 14 which act as masks to mask the light sources, i.e. fluorescent tubes 23. The images 43 are supported on the second side of the support and are viewed via the viewing regions in the support and the openings in the vinyl. The lightbox is releasably fastened to the support and the upturned edge helps to correctly locate the lightbox on the support and the recess is such that the end of the upturned edge is flush with the support.

In use, as it is the support that is permanently secured to the window, the lightbox can easily be released so as to change the images being displayed or so as to repair any faults in the lightbox. All the active parts of the display arrangement are in the lightbox and so there is no need to remove the support from the window should the display arrangement develop an illumination fault. The images are releasably attached to the support, or to the lightbox, and so it is easy to change the images being displayed without having to remove the support from the window. As the support masks the light sources and the images are illuminated by light reflected from the inner surface of the lightbox, the images are illuminated uniformly and unsightly bright patches arising from the light sources are not produced.

Alternatively, the images may be releasably attached to the opaque vinyl material or directly to the window. The images may also be located entirely within the viewing regions of the support.

The substantially planar first side of the support maximises the surface area of the support in contact with the window thereby increasing the shear force that would be required to dislodge the arrangement compared to that required if a lesser surface area were in contact with the window.

With reference to FIGS. 6*a*, 6*b*, 6*c*, 6*d*, and 7 an alternative arrangement according to the invention is shown designated generally by reference numeral 60.

FIG. 6*a* shows a rear view of a lightbox 61 of the display arrangement and the position of apertures 62 in a support of the arrangement in ghost lines when the arrangement is assembled. The lightbox has a housing in the form of a right rectangular box with an open face with a height of 920 mm, a width of 40 mm and a depth of 40 mm. The housing box may be made from moulded white foamed pvc.

FIG. 6*b* shows a side view of the lightbox. An expanded detail of the arrangement when assembled in use is shown in FIG. 6*d*.

FIG. 6*c* shows a view through the open side of the housing. The lightbox has a number of slimline fluorescent lamps 63 and electronic control units 64 and associated wiring (not shown). The positioning of the lamps and control units is chosen to suit the graphics to be displayed.

Figure 7:
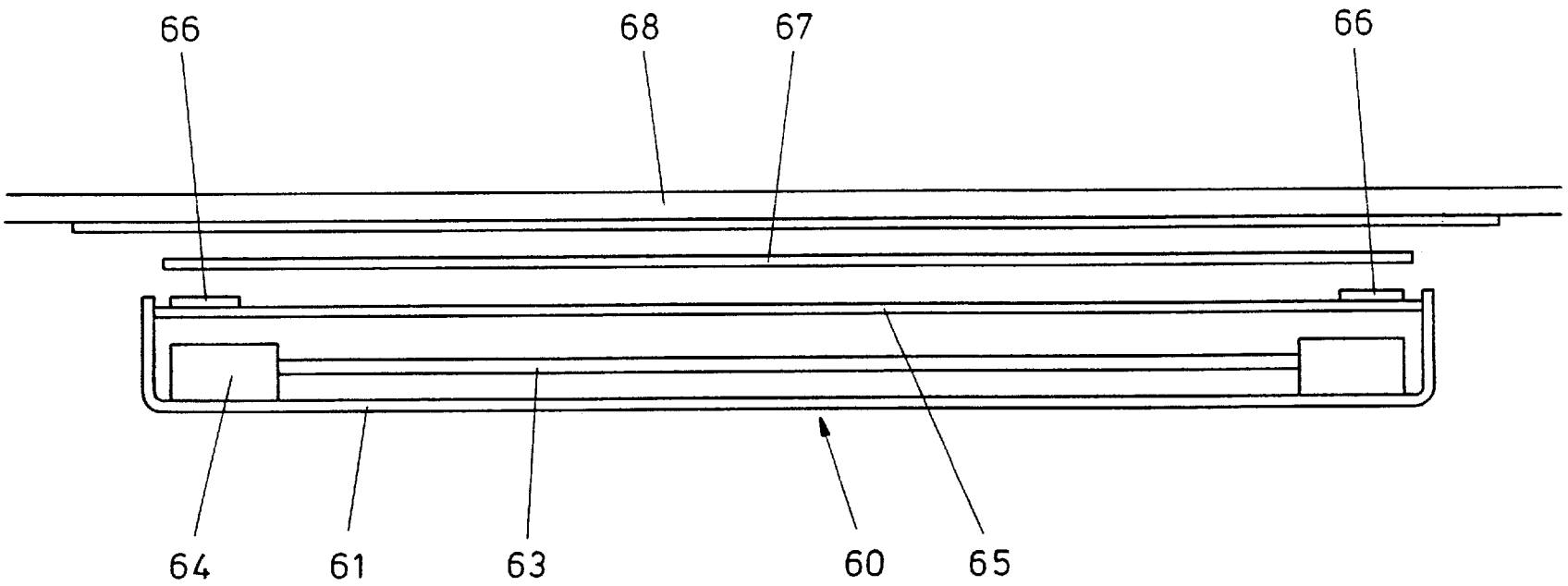
FIG. 7 is a partially exploded cross section along line AA in FIG. 6*a* of the alternative arrangement.

FIG. 7 shows a partially exploded section across line AA of FIG. 6*a* of the arrangement in use. The lightbox 61 has lamps 63 and electronic control units 64 in it. The housing of the lightbox also has a transparent acrylic cover. The cover helps to prevent damage to the internal electronics and helps prevent the ingress of dust when the arrangement is assembled and disassembled. The cover may be wholly transparent or have some opaque regions. The cover 65 part of the housing of the lightbox has releasable fastening means in the form of magnetic strips 66 extending along an outer surface of it. Other forms of magnetic material may be used on the housing and the magnetic material may be attached directly to the tray of the lightbox housing rather than the cover 65.

The support 67 is a substantially flat opaque article dimensioned to cover the housing and having apertures 62 in it as shown in ghost lines in FIG. 6*a*. The support has a releasable fastening means in the form of its constituent material. The support is made from rubber ferrite. Hence the housing can be releasably fastened to the support by the co-operative action of the magnetic strips 66 and the rubber ferrite material. It will be appreciated that any two magnetically attractive articles can be used to provide this magnetic releasable fastening of the housing and support.

An outer side of the support bears an adhesive by which the support is permanently attached to a window 68. The window has a layer of display graphics material secured directly to it and the support actually adheres to a surface of the display graphics material. The display graphics material plays a similar role to the opaque vinyl material of the previous example. The advertising materials to be illuminated in the lightbox are located between the cover 65 and the support 67.

The support 67 also has a locating formation 70 in the form of an L-shaped aluminum member. One leg 71 of the L-shaped member is attached to the support and the other leg 72 engages a locating formation provided on the lightbox 61. The locating formation on the lightbox is in the form of a gap between the cover 65 and the top wall 73 of the housing. The locating formation 70 helps to correctly position the lightbox with the support to ensure correct illumination. This is particularly useful when the lightbox and support are magnetically fastened together and there is not other mechanical guide to ensure correct alignment.

The configuration of the relative positions of opaque and transparent regions of the display graphics, support and cover are substantially as per the previous example. The opaque masking sections of the support mask out parts of the housing which are not to be displayed while allowing illumination of advertising material. The display graphics masks out the support of the lightbox so that only the illuminated advertisements and not the lightbox are seen when viewed form outside the window.

It will be appreciated that various combinations of lightbox shape, support aperture number and position and advertisement number and position can be easily realised with the current invention to provide an illuminated display suitable for any particular purpose.

What is claimed is:

1. A window display arrangement for use in connection with a window, said window display arrangement comprising a sheet of opaque window display material, a support and a lightbox, wherein:

the sheet of opaque window display material has a first side, to which an adhesive is applied so that the sheet can be secured directly to a side of the window, and a second side;

the support has a first side to which an adhesive is applied so that the support can be secured to the second side of the sheet and a second side having support releasably fastening means;

the lightbox comprises an illumination source and a housing having housing releasable fastening means which can co-operate with the support releasable fastening means so as to releasably fasten the lightbox to the support so that light from said illumination source in the housing is directed towards an image located, when the arrangement is in use, between the window and the lightbox, so that the illuminated image can be viewed through the window.

2. A window display arrangement according to claim 1, in which the support is located entirely within the periphery of the sheet of opaque window display material so that the support is not visible when the window display arrangement is viewed from the side of the window opposite to the side of the window to which the arrangement is attached.

3. An arrangement according to claim 2, in which the first side of the support is substantially planar.

4. An arrangement according to claim 3, in which the first side of the support is substantially planar.

5. An arrangement according to claim 4, in which the lightbox has an illumination source, the support has a viewing region and a masking region and the masking region masks the illumination source when the lightbox is fastened to the support.

6. An arrangement according to claim 5, in which the support has more than one viewing region and the illumination source comprises more than one light source.

7. An arrangement according to claim 6, in which the lightbox has a reflective internal surface which directs light from the illumination source towards the image.

8. An arrangement according to claim 7, in which one of the support releasable fastening means and housing releasable fastening means are studs and the other one are holes.

9. An arrangement according to claim 7, in which the support releasable fastening means and housing releasable fastening means co-operate magnetically.

10. An arrangement according to claim 9, in which the support has a locating formation which co-operates with the lightbox to ensure that the support and lightbox are correctly aligned when the arrangement is assembled.

11. An arrangement according to claim 10 in which the support releasable fastening means and housing releasable fastening means have locking devices to releasably lock the support and housing together when mated.

12. An arrangement according to claim 1, in which the support releasable fastening means and housing releasable fastening means are formations which mate with each other so as releasably to fasten the lightbox to the support.

13. An arrangement according to claim 1, in which the first side of the support is substantially planar.

14. An arrangement according to claim 1, in which the support has a viewing region and a masking region and the masking region masks light from the illumination source when the light box is fastened to the support.

15. An arrangement according to claim 14, in which the support has more than one viewing region and the illumination source comprises more than one light source.

16. An arrangement according to claim 1, in which the lightbox has a reflective internal surface which directs light from the illumination source towards the image.

17. An arrangement according to claim 1, in which one of the support releasable fastening means and housing releasable fastening means are studs and the other one are holes.

18. An arrangement according to claim 1, in which the support releasable fastening means and housing releasable fastening means co-operate magnetically.

19. An arrangement according to claim 1, in which the support has a locating formation which co-operates with the lightbox to ensure that the support and lightbox are correctly aligned when the arrangement is assembled.

20. An arrangement according to claim 1, in which the support releasable fastening means and housing releasable fastening means have locking devices to releasably lock the support and housing together when mated.

* * * * *